United States Patent [19]

Staisch

[11] 3,971,397

[45] July 27, 1976

[54] PUMP UNLOADING VALVE DEVICE

[75] Inventor: Diether Staisch, Walsrode, Germany

[73] Assignee: WABCO Westinghouse GmbH, Hannover, Germany

[22] Filed: June 5, 1975

[21] Appl. No.: 584,189

[52] U.S. Cl. ..... 137/116

[51] Int. Cl.[2] ..... G05D 16/10

[58] Field of Search ..... 60/418; 137/115, 116; 417/307

[56] References Cited

UNITED STATES PATENTS

| | | | |
|---|---|---|---|
| 1,731,145 | 10/1929 | MacMillen | 137/116 |
| 2,339,378 | 1/1944 | Clench | 137/116 |
| 2,501,054 | 3/1950 | Huber | 137/116 |

*Primary Examiner*—Robert G. Nilson
*Attorney, Agent, or Firm*—W. F. Poore; R. W. McIntire, Jr.

[57] ABSTRACT

This invention relates to a pump unloader that includes two cylindrical valve members of the same diameter slidably mounted in the same bore and each biased in the same direction by its own spring. These valve members are so connected by a lost-motion connection as to be simultaneously shiftable in one direction upon storage reservoir pressure acting on one valve member reaching a chosen cut-out pressure until the other valve member begins to open a communication whereupon this other valve member is subject to pump discharge pressure to cause it to be quickly shifted relative to the one valve member to a pump unloading position in which the pump discharge is returned to a sump. Thereafter, as reservoir pressure is reduced, both valve members are simultaneously shiftable in an opposite direction to cut off flow from the pump to the sump whereupon the pump is reloaded after which the spring acting on the other valve member shifts it relative to the one valve member to its original position with respect to this one valve member.

10 Claims, 3 Drawing Figures

PUMP UNLOADING VALVE DEVICE

BACKGROUND OF THE INVENTION

Heretofore known pump unloading valve devices have been expensive in that they have embodied two or more valves and pistons of different diameters slidably mounted in corresponding bores. Moreover, these valves often chatter.

Accordingly, it is the general purpose of this invention to provide a small, inexpensive nonchattering pump unloading valve device that includes two cylindrical valve members having the same diameter so as to be slidably mounted in a common bore each being biased in the same direction by its own spring means and so connected by a lost-motion connection as to be simultaneously shiftable in one direction upon storage reservoir pressure acting on one valve member reaching a chosen cut-out pressure until the other valve member begins to open a communication whereupon this other valve member is subject to pump discharge pressure to cause it to be quickly shifted relative to the one valve member to a pump unloading position in which the pump discharge is returned to a sump. Thereafter, as reservoir pressure is reduced, both valve members are simultaneously shiftable in an opposite direction to cut off flow from the pump to the sump whereupon the pump is reloaded after which the spring means acting on the other valve member shifts it relative to the one valve member to its original position with respect thereto.

SUMMARY OF THE INVENTION

According to the present invention, there is provided for use with a fluid pump, an unloading valve device disposed in a conduit connecting the discharge of the pump to a fluid storage reservoir. This unloading valve device comprises a casing having therein a plurality of passageways and a spring-loaded check valve between two of the passageways through which fluid under pressure flows from the pump to the reservoir and an unloading valve for connecting the discharge of the pump to a sump upon reservoir pressure increasing to a certain chosen cut-out value. The unloading valve comprises two cylindrical valve members of equal diameter slidably mounted in the same bore provided therefor in the casing. Separate spring biasing means acts, in the same direction, on the outer end of each valve member. The adjacent inner ends of these valve members are connected by a lost-motion connection that forms a chamber therebetween and includes disposed in this chamber a cylindrical forked member that is integral with one valve member and straddles a member connecting a stop or headed member and the adjacent end of the other valve member. The other end of the one valve member is subject to reservoir pressure which, upon exceeding a chosen cut-out value, is effective to shift both valve members in one direction against the yielding resistance of their respective spring-biasing means until the other valve member begins to open a communication for supplying fluid under pressure from the pump to a chamber in the lost-motion connection between the valve members. A communication extending from this chamber to a sump has a spring-loaded check valve disposed therein to enable the establishment in this chamber of a momentarily retained pressure that acts on the adjacent end of the the other valve member thereby quickly shifting it, relative to both the casing and the one valve member, to a completely opened position thereby providing for flow from the pump to the sump via the spring-loaded check valve and thus unloading the pump.

Thereafter, as the pressure in the reservoir and effective on the other end of the one valve member is reduced by use of fluid under pressure from the reservoir, both valve members are simultaneously shifted in an opposite direction by the springs acting thereon until the other valve member cuts off flow from the pump to the sump thereby reloading the pump whereupon the spring acting on this other valve member is rendered effective to shift this valve member relative to the one valve member the distance provided by the lost-motion connection, this shifting of the other valve member being effective to force the fluid under pressure in the chamber between the valve members to flow past the check valve to the sump.

DESCRIPTION - FIGS. 1 AND 2

Figure 1:
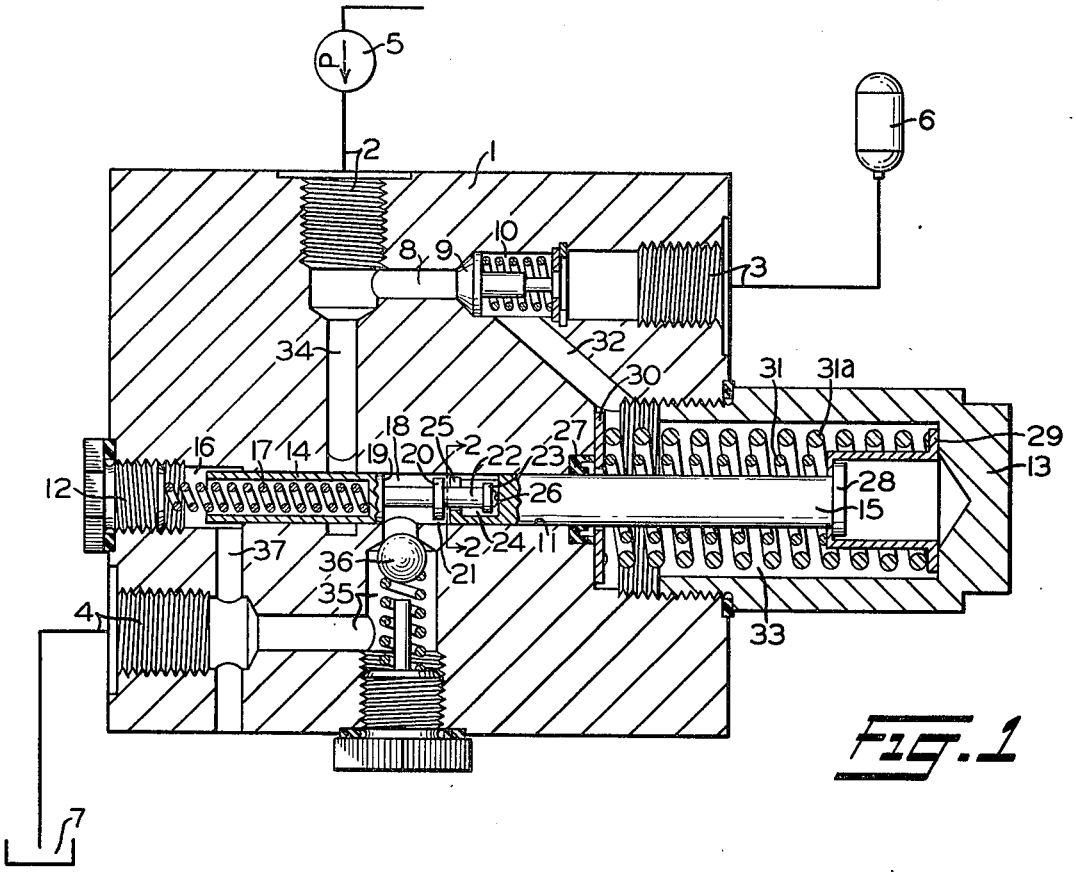
FIG. 1 is a diagrammatic view of a storage reservoir and a pump for supplying fluid under pressure thereto via a conduit having an unloading valve device, shown in cross-section, disposed therein.

As shown in FIG. 1 of the drawings, an unloading valve device constituting a first embodiment of the present invention comprises a casing or housing 1 having therein three passageways 2, 3 and 4 which are respectively connected by correspondingly numbered pipes to a fluid pressure pump 5, a fluid pressure storage reservoir or accumulator 6 and a return tank or sump 7. The passageways 2 and 3 are connected by a passageway or bore 8 that has therein a spring-biased check valve 9 that provides for one-way flow of fluid under pressure from the passageway 8 to a chamber 10 into which opens the passageway 3.

Extending through the casing 1 in spaced-apart parallel relation to the passageways 3 and 8 is a bore 11 the left-hand end of which, as viewed in FIG. 1, is closed by a screw-threaded plug 12. The right-hand end of the bore 11 opens into a coaxial screw-threaded counterbore the open end of which is closed by a cup-shaped screw-threaded plug 13.

Slidably mounted in the bore 11 are two cylindrical valve members 14 and 15. The valve member 14 extends into a chamber 16 formed in the casing 1 between the end of this valve member 14 which is cup-shaped and the plug 12 there being a spring 17 disposed in this cup-shaped valve member and interposed between this valve member 14 and the plug 12.

Figure 2:
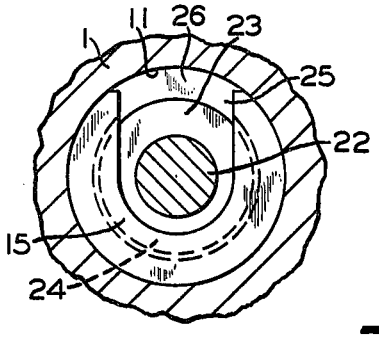
FIG. 2 is a cross-sectional view, taken along the line 2-2 of FIG. 1 and looking in the direction of the arrows, showing certain details of the unloading valve device not made apparent in FIG. 1.

As shown in FIG. 1, an annular chamber 18 is formed in the bore 11 between the right-hand end 19 of the cylindrical valve member 14 and a collar 20 formed intermediate the ends of a portion of this valve member that is smaller in diameter than the remainder. The purpose of collar 20 is to prevent chattering of valve member 14. Consequently, the diameter of collar 20 is a chosen amount less than that of the bore 11 to provide for a restricted rate of flow of fluid under pressure from the annular chamber 18 via the annular area or restriction 21 formed between the wall surface of the bore 11 and the collar 20 from the right-hand side of which extends a cylindrical member 22 that has formed on its end a head member 23 that is disposed in a recess or chamber 24. This chamber 24 is formed in the cylindrical valve member 15 as by, for example, a milling operation. As best shown in FIG. 2, that portion of the cylindrical valve member 15 on the left-hand side of the recess or chamber 24 is provided with, as by, for example, a second milling operation, a U-shaped slot 25 in which is received the cylindrical member 22. The right-hand end of the recess or chamber 24 forms a stop surface 26 for the head member 23 it being noted that the thickness of this head member is substantially less than the width of the recess 24.

From the foregoing, it is apparent that the recess 24 and the U-shaped slot 25 constitute a forked portion or member that is formed integral with the left-hand end, as viewed in FIG. 1, of the cylindrical valve member 15 so as to straddle the cylindrical member 22 that extends between the right-hand end of the cylindrical valve member 14 and the head member 23.

It will be noted from the drawings that the head member 23 may move in the direction of the left hand from the position in which it is shown in abutting relationship with the stop surface 26 to a position in which it abuts that portion of the cylindrical valve member 15 having therein the slot 25. Thus, this distance that the head member 23 may be moved relative to the cylindrical valve member 15 constitutes the length of the lost-motion connection between valve members 14 and 15.

As shown in FIG. 1, the right-hand end of bore 11 opens into a coaxial counterbore in which is disposed an annular resilient seal 27. This seal 27 prevents leakage of fluid under pressure along the peripheral surface of the cylindrical valve member 15 which at its right-hand end has a collar 28 formed integral therewith.

A spring seat 29 is in the form of a sleeve that has an inturned flange at its left-hand end and an outturned flange at its right-hand end. Disposed in surrounding relation to the cylindrical valve member 15 and interposed between the inturned flange on the spring seat 29 and a second spring seat 30 is a first spring 31. A second spring 31a is disposed in surrounding relation to the first spring 31 and is interposed between the outturned flange on the spring seat 29 and the second spring seat 30. These springs 31 and 31a normally bias the valve member 15 and the spring seat 29 to the position shown in FIG. 1 in which the outturned flange on the spring seat 29 abuts the cup-shaped plug 13.

Formed in the casing 1 is a passageway 32 that at one end opens into the hereinbefore-mentioned chamber 10 in this casing and at its opposite end opens into a chamber 33 formed by the cooperative relationship of this casing 1 and the cup-shaped plug 13.

Also formed in the casing 1 is a passageway 34 that at one end opens at the junction of passageways 2 and 8 and at the other end opens at the wall surface of the bore 11 at such a location that, while the cylindrical valve member 14 occupies the position in which it is shown in FIG. 1, this valve member 14 closes communication between this passageway 34 and the chamber 18 which is connected to the return tank or sump 7 via a passageway 35 having a spring-biased check valve 36 disposed therein and the passageway and pipe 4.

A passageway 37 provided in the casing 1 opens at one end into the chamber 16 and at the other end into the passageway 4. Consequently, the left-hand end of the cylindrical valve member 14 is always subject to the pressure in the return tank or sump 7.

OPERATION

With the pump 5 stopped and no fluid under pressure present in the passageways 2 and 8 in the casing 1 of the unloading valve device, the spring-biased check valve 9 closes communication between the passageway 8 and chamber 10.

Chamber 33 is connected to the reservoir 6 via passageway 32, chamber 10 and passageway and pipe 3. Assuming that reservoir 6 and chamber 33 are void of fluid under pressure, the springs 31 and **31*a* are effective on the inturned and outturned flanges of the spring seat 29 to move this spring seat 29 and the cylindrical valve member 15 to the position shown in FIG. 1 in which the outturned flange abuts the cup-shaped plug 13 and the inturned flange abuts the left-hand side of the collar 28 that is integral with the right-hand end of the valve member 15**.

With the cylindrical valve member 15 biased to the position in which it is shown in FIG. 1, the spring 17 is effective to bias the cylindrical valve member 14 to the position in which it is shown in FIG. 1, it being noted that in this position of the cylindrical valve member 14 it is effective to close communication between the passageway 34 and the chamber 18.

Furthermore, the spring 17 is effective at this time to bias the head member 23 against the stop surface 26, as shown in FIG. 1.

When the pump 5 is driven by some suitable type of prime mover (not shown), it will supply fluid under pressure to the check valve 9 via pipe and passageway 2 and passageway 8 to cause unseating of the spring-biased check valve 9 whereupon fluid under pressure will flow to the reservoir 6 via the chamber 10 and passageway and pipe 3.

Moreover, fluid under pressure will flow from the chamber 10 to the chamber 33 via the passageway 32 so that the pressure in the reservoir 6 and the chamber 33 increases simultaneously.

As the pressure in the chamber 33 increases above a certain chosen cut-out pressure, it is effective on the right-hand end of the cylindrical valve member 15 to shift this valve member 15 in the direction of the left hand, as viewed in FIG. 1, against the yielding resistance of the springs 31 and **31*a*, it being noted that the collar 28 integral with the right-hand end of valve member 15 abuts the right-hand side of the inturned flange on the left-hand end of the spring seat 29 to cause this spring seat 29 to be shifted simultaneously with the valve member 15 and thus compressing the springs 31 and 31*a***.

Since the head member 23 abuts the stop surface 26 on the valve member 15 and this head member 23 is connected to the cylindrical valve member 14 by the cylindrical member 22, collar 20 and the portion of reduced diameter of the valve member 14 extending between the collar 20 and the right-hand end 19 of this valve member 14, it is apparent that as the valve member 15 is shifted in the direction of the left hand, as viewed in FIG. 1, the cylindrical valve member 14 will be simultaneously shifted in the direction of the left hand against the yielding resistance of the spring 17.

After the right-hand end 19 of the cylindrical valve member 14 is shifted in the direction of the left hand a certain distance from the position in which it is shown in FIG. 1, it will begin to open a communication that extends between the passageway 34 and the chamber 18. As the right-hand end 19 of the cylindrical valve member 14 begins to open this communication, a low pressure annular area is formed between this end 19 and the annular edge formed by the intersection of the passageway 34 and the bore 11 so that fluid under pressure will flow from the passageway 34 into the chamber 18 at a high velocity, it being understood that this annular area constitutes a Venturi tube.

It should be noted, first, that the spring-biased check valve 36 prevents flow of fluid under pressure from the chamber 18 to the return tank 7 via the passageway 35 and passageway and pipe 4 until the pressure in the chamber 18 is built up to a value that is of sufficient magnitude to overcome this spring bias, and, second, the annular area between the peripheral surface of the collar 20 and the wall surface of the bore 11 constitutes a choke or restriction 21 through which fluid under pressure must pass as it flows from the chamber 18 to the chamber 24. Thus, the spring-biased check valve 36 and the restriction 21 provided by the collar 20 prevent a rapid flow of fluid under pressure from the chamber 18 so that a limited momentary buildup of pressure occurs in this chamber 18.

It will be noted that since the diameter of the collar 20 is less than the diameter of the bore 11, the buildup of pressure in the chamber 18 caused by the spring-biased check valve 36 and the restriction 21 caused by the collar 20 will establish a differential fluid pressure force which acts in the direction of the left hand, as viewed in FIG. 1, on the right-hand end 19 of the cylindrical valve member 14. Since this force on the valve member 14 acts in the direction to cause this valve member 14 to maintain open the communication between the passageway 34 and the chamber 18 chattering or repeatedly rapidly causing this valve member 14 to open and reclose the communication between the passageway 34 and the chamber 18 is prevented.

As soon as the pressure in the chamber 18 is increased sufficiently to overcome the spring bias of the check valve 36, this check valve will be unseated to establish a communication from the chamber 18 to the return tank 7 via this open check valve 36, passageway 35 and passageway and pipe 4.

It will be apparent that the fluid under pressure discharged by the pump 5 will now flow to the return tank 7 via pipe and passageway 2, passageway 34, past the right-hand end 19 of now fully open cylindrical valve member 14, chamber 18, past unseated check valve 36, passageway 35 and passageway and pipe 4.

It should be understood that the check valve 10 is subject to a smaller spring bias than the check valve 36. Therefore, as the pump 5 continues to be driven by its prime mover, this pump 5 will recirculate fluid from the return tank 7, which is connected to the inlet of this pump by a conduit (not shown), through the pump and back to this return tank. The pressure in the discharge conduit (2, 34, 18, 35 and 4) will be high enough to maintain both of the check valves 9 and 36 open but there will be no further increase of pressure in the reservoir 6 since all of the fluid under pressure discharged by the pump 5 is now returned to the tank or sump 7. Consequently, it is apparent that the pump 5 will now operate unloaded so long as the pressure in the reservoir 6 and chamber 33 is not reduced to a certain chosen cut-in pressure by use of fluid under pressure from the reservoir 6.

It should be noted that the chamber 16 is connected to the passageway and pipe 4 by the passageway 37. Therefore, the pressure in the chamber 16 is the same as that in the return tank 7 and on the outlet side of the check valve 36.

Now let it be supposed that the pressure in the reservoir 6 and the chamber 33 is reduced as the result of use of fluid under pressure from the reservoir 6.

As the pressure in the reservoir 6 and chamber 33 is reduced below the above-mentioned certain chosen cut-out pressure, the springs 31 and 31*a* are rendered effective to shift the cylindrical valve member 15 in the direction of the right hand, as viewed in FIG. 1.

The pressure in the chamber 16, which is the same as that present in the return tank 7, together with the force of the spring 17 acts on the entire area of the cylindrical valve member 14 in the direction of the right hand, as viewed in FIG. 1. The fluid under pressure present in the chamber 18 acts in the direction of the left-hand on an area equal to the area of the cylindrical valve member 14 less the area of the reduced diameter portion of this valve member extending from the right-hand end 19 of this valve member 14 to the collar 20. Thus, the cylindrical valve member 14 is subject to a force that is equal to the difference in these two forces.

However, the pressure in the chamber 18 equalizes after a small instant of time into the chamber 24 via the choke or restriction 21 constituted by the difference in the area of the collar 20 and the area of the bore 11.

Therefore, subsequent to this equalization of pressure in the chambers 18 and 24, this equalized pressure acts in the direction of the left hand on the entire area of the cylindrical valve member 14 and in the direction of the right hand on the entire area of the cylindrical valve member 15.

Since the check valve 36 is spring biased, it is apparent that the pressure in the chamber 18 is higher than the pressure in the chamber 16 while the pump 5 is operating unloaded. Accordingly, while the pump 5 is operating unloaded, the cylindrical valve member 14 is subject to a differential fluid pressure force which acts in the direction of the left hand, as viewed in FIG. 1, to hold this valve member 14 in a fully open position.

Consequently, as the springs 31 and 31*a* shift the cylindrical valve member 15 in the direction of the right hand, as viewed in FIG. 1, in response to the pressure in the chamber 33 and reservoir 6 reducing from the above-mentioned certain chosen cut-out pressure to the above-mentioned certain chosen cut-in pressure, the cylindrical valve member 14 will be simultaneously shifted in the direction of the right hand until the right-hand end 19 of this valve member 14 is moved far enough to close communication between the passageway 34 and the chamber 18 to thereby reload the pump 5.

With the flow of fluid under pressure from the pump 5 to the chamber 18 thus cut off, the fluid under pressure in the chamber 18 will flow past the check valve 36 to the return tank 7 via the passageway 35 and passageway and pipe 4 and also to the chamber 16 which is connected to the passageway 35 by the passageway 37.

It will be noted that a pressure will be retained in the chamber 18 that is excess of that in the chamber 16 by an amount corresponding to the value of the spring acting on the check valve 36. This retained pressure in the chamber 18 acts in the direction of the left hand on the cylindrical valve member 14 whereas the lesser pressure in the chamber 16 and the force of the spring 17 act in the direction of the left hand on this valve member 14. The strength of the spring 17 is such that the force acting in the direction of the right hand on the valve member 14 exceeds the force acting in the direction of the left hand. Consequently, after the pump 5 is reloaded by the valve member 14 cutting off flow of fluid under pressure from the pump 5 to the return tank 7 so that this pump 5 again supplies fluid under pressure to the storage reservoir 6 and chamber 33 thereby preventing further shifting of the valve member 15 in the direction of the right hand by the springs 31 and 31*a* the spring 17 shifts the cylindrical valve member 14 relative to the cylindrical valve member 15 until the head member 23 that is integral with the valve member 14 abuts the stop surface 26 on the valve member 15, as shown in FIG. 1.

When the pressure in the reservoir 6 and chamber 33 again reaches the certain chosen cut-in pressure, the pump 5 will be unloaded in the manner hereinbefore described.

DESCRIPTION - FIG. 3

Figure 3:
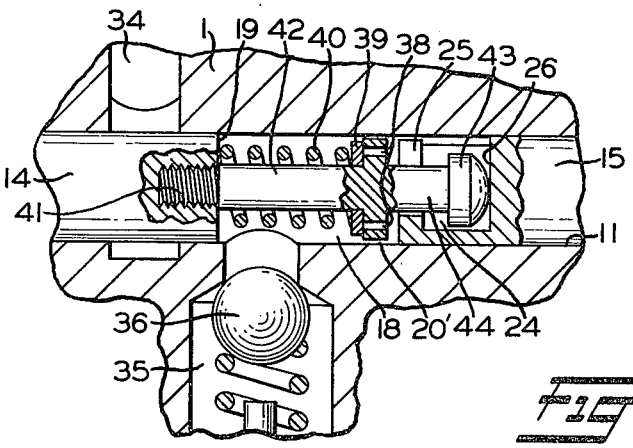
FIG. 3 is a cross-sectional view of two valve elements of the unloading valve device shown in FIG. 1 connected by a lost-motion connection constructed in accordance with a second embodiment of the invention.

A second embodiment of the invention comprises a pump unloading valve device that is the same in construction as the unloading valve device shown in FIG. 1 except that the lost-motion connection shown in FIG. 1 between the cylindrical valve members 14 and 15 is replaced by the lost-motion connection shown in FIG. 3. Accordingly, like reference numerals have been used to designate the structure shown in FIG. 3 which is identical to that shown in FIGS. 1 and 2. Only such features of the structure and operation of the embodiment of the invention shown in FIG. 3 which differ from that of the embodiment of FIGS. 1 and 2 will be hereinafter described.

According to the embodiment of the invention disclosed in FIG. 3, a collar 20′ has a diameter that is greater than the diameter of the collar 20 shown in FIG. 1 and only slightly less than the diameter of the bore 11. This collar 20′ is provided with a plurality of arcuately-spaced bores 38 only two of which appear in FIG. 3. The left-hand end of the bores 38 are normally closed by an annular disc valve 39 between which and the right-hand end 19 of the cylindrical valve member 14 is interposed a spring 40.

In order to provide for the assembly of the annular disc valve 39 and the spring 40, the right-hand end of the cylindrical valve member 14 is provided with an internally screw-threaded bottom bore 41. The above-mentioned collar 20′ is formed integral with a cylindrical member 42 intermediate the ends thereof. External screw threads are provided on the cylindrical member 42 adjacent its left-hand end to enable this member 42 to be secured to the right-hand end of the cylindrical valve member 14 subsequent to placing the annular disc valve 39 and the spring 40 in surrounding relation to that portion of this member 42 that is on the left-hand side of the collar 20′.

A head member 43 is formed at the right-hand end of the cylindrical member 42. This head member 43 corresponds to the head member 23 shown in FIG. 1 and is spaced from the collar 20′ the distance that the head member 23 is spaced from the collar 20.

As in the first embodiment of the invention, a chamber 24 and a U-shaped slot 25 are provided in cylindrical valve member 15. The right-hand end of the chamber 24 forms the stop surface 26 for the head member 43 and a portion 44 of the cylindrical member 42 extending between the collar 20° and this head member 43 is of such a diameter as to enable it to be received in the U-shaped slot 25.

OPERATION - FIG. 3

Operation of the second embodiment of the invention is the same as that of the first embodiment except as hereinafter explained.

The diameter of the collar 20° is greater than the diameter of the collar 20 shown in FIG. 1. Therefore, the flow of fluid under pressure from the chamber 18 to the chamber 24 is more restricted in this second embodiment of the invention. Consequently, the time for effecting equalization of pressures in these chambers is longer in the unloading valve device using a lost-motion connection between valve members 14 and 15 constructed as shown in FIG. 3.

Upon the pressure in the reservoir 6 and chamber 33 reaching the certain chosen cut-out pressure, the pump 5 will be unloaded in the manner hereinbefore described. When cylindrical valve 14 begins to open the communication between passageway 34 and chamber 18, the fluid under pressure supplied to this chamber 18 cannot flow to the chamber 24 as fast as in the first embodiment of the invention. Therefore, the pressure in the chamber 18 shown in FIG. 3 will build up more rapidly than will the pressure in the chamber 18 shown in FIG. 1. Consequently, this more rapid rise of pressure in the chamber 18 will cause the cylindrical valve 14 shown in FIG. 3 to be shifted to its completely opened position more quickly than the cylindrical valve 14 shown in FIG. 1 is shifted to its completely opened position.

Subsequent to the springs 31 and 31*a* moving the cylindrical valve members 14 and 15 in the direction of the right hand to the position in which valve member 14 closes communication between passageway 34 and chamber 18 in response to the reduction of pressure in the reservoir 6 and chamber 33 as the result of use of fluid under pressure from the reservoir 6, the fluid under pressure present in the chamber 18 will flow to the return tank 7 via check valve 36, passageway 35 and passageway and pipe 4 thereby reducing the pressure in the chamber 18.

As the pressure in the chamber 18 is reduced by flow of fluid under pressure therefrom to the return tank 7, the higher pressure in the chamber 24 and effective on the right-hand side of the disc valve 39 via bores 38 will shift this valve 39 against the yielding resistance of the spring 40 in the direction of the left-hand, as viewed in FIG. 3, to thereby uncover the bores 38 in the collar 20′. The fluid under pressure in the chamber 24 can now flow to the chamber 18 via the bores 38 in the collar 20′ and also via the choke constituted by the difference in the area of the bore 11 and the area of the collar 20′.

From the foregoing, it is apparent that the flow of fluid under pressure from the chamber 24 shown in FIG. 3 to the chamber 18 is more rapid than is the flow from the chamber 24 shown in FIG. 1. Therefore, the return of the cylindrical valve member 14 shown in FIG. 3 to the position in which the head member 43 abuts the stop surface 26 on the cylindrical valve member 25 is quicker than the return of the cylindrical valve member 14 shown in FIG. 1 to the position in which head member 23 abuts the stop surface 26 shown in FIG. 1.

Having now described the invention what I claim as new and desire to secure by Letters Patent, is:

1. For interposition in a conduit connecting the discharge of a fluid pressure pump to a fluid pressure storage reservoir, an unloading valve device operative to control flow of fluid under pressure from the pump to either the reservoir or a return tank, said unloading valve device comprising:

a. a casing having formed therein a plurality of passageways and a bore extending through said casing and intersecting a first pair of said passageways, one of which is connected to the discharge of the pump and the other to the return tank, b. a one-way flow valve providing for the flow of fluid under pressure from said one passageway to the storage reservoir and preventing reverse flow from said reservoir, wherein the improvement comprises:

c. a pair of cylindrical valve members of equal diameter slidably mounted in said bore and cooperating with said bore to form a chamber between their adjacent ends, the other end of one of said cylindrical valve members being so subject to the pressure in the storage reservoir as to enable said pressure to shift said valve members in one direction in said bore until the adjacent end of the other valve member begins to open a communication between said one passageway of said pair of passageways and said chamber, d. separate biasing means acting on each valve member in the direction opposite said one direction, e. a lost-motion connection connecting said cylindrical valve members and disposed in said chamber therebetween, and f. means restricting flow of fluid under pressure from said chamber to the return tank and thereby effective, upon said adjacent end of said other valve member beginning to open said communication, to cause the fluid under pressure admitted from the discharge of the pump to said chamber to establish a pressure therein to shift said other valve member, relative to said one valve member a distance corresponding to said lost-motion connection, to a fully open position.

2. An unloading valve device, as recited in claim 1, further characterized in that another of said plurality of passageways in said casing enables the other end of said other valve member to be always subject to the pressure in the return tank whereby said pressure in the return tank acts in cooperation with said separate biasing means acting on said other valve member to shift said other valve member relative to said one valve member a distance corresponding to said lost-motion connection subsequent to said biasing means acting on said one valve member in response to a chosen reduction of pressure in said reservoir shifting both of said valve members in the direction opposite said one direction to a position in which said other valve member closes said communication between said one passageway and said chamber.

3. An unloading valve device, as recited in claim 1, further characterized by biasing means acting in a closing direction on said one-way flow valve.

4. An unloading valve device, as recited in claim 1, further characterized by means providing for a restricted release of fluid under pressure from said chamber independently of said means restricting flow from said chamber to said return tank.

5. An unloading valve device, as recited in claim 4, further characterized in that said means providing for restricted release of fluid under pressure from said chamber independently of said means restricting flow to said return tank comprises a collar carried by said other valve member and disposed in said bore and having a diameter sufficiently less than the diameter of said bore as to provide an annular clearance between the periphery of said collar and the wall surface of said bore that enables said independent restricted release of fluid under pressure from said chamber.

6. An unloading valve device, as recited in claim 1, further characterized by means carried by said other valve member and so disposed in said bore as to cooperate with the wall surface thereof to form a restricted communication for the flow of fluid under pressure from said chamber independently of said means restricting flow from said chamber to said return tank whereby a momentarily buildup of pressure occurs in said chamber to cause shifting of said other valve member relative to said one valve member said distance correspondingto said lost-motion connection.

7. An unloading valve device, as recited in claim 1, further characterized in that said lost-motion connection connecting said valve member comprises:

a. a head member, b. a connecting member connecting said head member to said adjacent end of said other valve member, and c. a forked member formed integral with said adjacent end of said one valve member and disposed in straddling relation to said connecting member, said forked member enabling limited shifting in either direction of said head member and said other valve member with respect to said one valve member.

8. An unloading valve device, as recited in claim 1, further characterized by means carried by said other valve means and so disposed in said bore as to provide a chamber on each side thereof, said means cooperating with the wall surface of said bore to form a restricted communication for the flow of fluid under pressure between said chambers, and said means including a check valve means providing for unrestricted flow of fluid under pressure from one of said chambers to the other in parallel with flow through said restricted communication.

9. An unloading valve device, as recited in claim 8, further characterized in that said means carried by said other valve member comprises:

a. a collar disposed in spaced-apart relation to said adjacent end of said other valve member to form therebetween said other chamber and provided with a plurality of arcuately arranged bores extending therethrough, and said check valve means comprises:

b. a disc-type valve so disposed as to enable flow of fluid under pressure from said one chamber to said other chamber via said bores in said collar and prevent flow of fluid under pressure from said other chamber to said one chamber via said bores, and c. a spring interposed between said adjacent end of said other valve member and said disc-type valve normally biasing said disc-type valve against one side of said collar to cut off flow of fluid under pressure from said one chamber to said other chamber via said ports in said collar.

10. An unloading valve device, as recited in claim 1 further characterized in that said means providing restricted flow from said chamber to said return tank comprises a spring-biased check valve.

* * * * *